US009671145B2

(12) United States Patent
Koppineedi

(10) Patent No.: US 9,671,145 B2
(45) Date of Patent: Jun. 6, 2017

(54) COMBINED ACCUMULATOR AND RECEIVER TANK

(71) Applicant: THERMO KING CORPORATION, Minneapolis, MN (US)

(72) Inventor: Srinivasa Rao Koppineedi, Bangalore (IN)

(73) Assignee: THERMO KING CORPORATION, Minneapolis, MN (US)

( * ) Notice: Subject to any disclaimer, the term of this patent is extended or adjusted under 35 U.S.C. 154(b) by 0 days.

(21) Appl. No.: 14/435,091

(22) PCT Filed: Oct. 14, 2013

(86) PCT No.: PCT/US2013/064828
§ 371 (c)(1),
(2) Date: Apr. 10, 2015

(87) PCT Pub. No.: WO2014/059410
PCT Pub. Date: Apr. 17, 2014

(65) Prior Publication Data

US 2015/0267949 A1 Sep. 24, 2015

Related U.S. Application Data

(60) Provisional application No. 61/713,084, filed on Oct. 12, 2012.

(51) Int. Cl.
*F25B 1/00* (2006.01)
*F25B 43/00* (2006.01)
(Continued)

(52) U.S. Cl.
CPC ..... *F25B 43/006* (2013.01); *F25B 33/00* (2013.01); *F25B 41/04* (2013.01); *F25B 13/00* (2013.01);
(Continued)

(58) Field of Classification Search
CPC F25B 2400/16; F25B 43/006; F25B 2400/23; F25B 2400/53; F25B 2400/24; F25B 33/00
See application file for complete search history.

(56) References Cited

U.S. PATENT DOCUMENTS 2,592,712 A 4/1952 Knoy
2,966,043 A 12/1960 Ross
(Continued)

FOREIGN PATENT DOCUMENTS

EP 1096210 A2 2/2001
EP 1096210 5/2001
(Continued)

OTHER PUBLICATIONS

English Machine Translation of JPH11248267.*
(Continued)

*Primary Examiner* — David Teitelbaum
(74) *Attorney, Agent, or Firm* — Hamre, Schumann, Mueller & Larson, P.C.

(57) ABSTRACT

A combined accumulator and receiver tank of a refrigeration system is described. The tank may have an accumulator portion positioned above a receiver portion. An accumulator/receiver pipe (AR pipe) connects the accumulator portion to the receiver portion. The AR pipe may have a valve that allows liquid refrigerant to flow from the accumulator portion to the receiver portion during a heating and/or defrost, and prevent the fluid flow when the refrigeration system is in a cooling cycle. In some embodiments, a side opening that is connected to the AR pipe is above an oil pick up orifice of an accumulator suction line pipe.

16 Claims, 3 Drawing Sheets

(51) Int. Cl.

| | |
|---|---|
| ***F25B 33/00*** | (2006.01) |
| ***F25B 41/04*** | (2006.01) |
| *F25B 13/00* | (2006.01) |
| *F25B 47/02* | (2006.01) |

(52) U.S. Cl.
CPC ..... *F25B 47/022* (2013.01); *F25B 2400/0401* (2013.01); *F25B 2400/053* (2013.01); *F25B 2400/16* (2013.01); *F25B 2400/19* (2013.01); *F25B 2400/23* (2013.01); *F25B 2400/24* (2013.01); *F25B 2500/18* (2013.01); *F25B 2600/2501* (2013.01)

(56) References Cited

U.S. PATENT DOCUMENTS

| | | | | |
|---|---|---|---|---|
| 3,084,523 | A | | 4/1963 | Bottum et al. |
| 3,177,680 | A | | 4/1965 | Crowl et al. |
| 3,212,289 | A | | 10/1965 | Bottum |
| 3,487,656 | A | * | 1/1970 | Grant ..... F25B 41/00 62/174 |
| 3,721,104 | A | | 3/1973 | Adler |
| 4,106,307 | A | | 8/1978 | Matsuda |
| 4,236,381 | A | | 12/1980 | Imral et al. |
| 4,537,045 | A | | 8/1985 | Mayer |
| 4,542,783 | A | | 9/1985 | Fujimoto |
| 4,872,316 | A | * | 10/1989 | Browne ..... F25B 43/00 184/108 |
| 5,007,247 | A | | 4/1991 | Danig |
| 5,531,077 | A | | 7/1996 | Formenti |
| 5,694,783 | A | | 12/1997 | Bartlett |
| 6,253,572 | B1 | | 7/2001 | Bottum et al. |

FOREIGN PATENT DOCUMENTS

| | | |
|---|---|---|
| JP | 10-220880 | 8/1998 |
| JP | 11-173698 | 7/1999 |
| JP | 11-248267 | 9/1999 |
| JP | 11248267 | 9/1999 |
| JP | 2000-234816 | 8/2000 |
| JP | 2001-124442 | 5/2001 |
| WO | 2010/143815 | 12/2010 |

OTHER PUBLICATIONS

International Search Report and Written Opinion for International Application PCT/US2013/064828, dated Jan. 24, 2014, 12 pgs.
Chinese Office Action for the corresponding Chinese Application No. 201380052971.4 dated Dec. 2, 2015 (5 pages).
Supplementary Partial European Search Report issued in corresponding European Application No. 13845699.1 dated Nov. 18, 2016 (9 pages).

* cited by examiner

COMBINED ACCUMULATOR AND RECEIVER TANK

FIELD OF TECHNOLOGY

The embodiments disclosed herein relate generally to a refrigeration system. More particularly, the embodiments relate to a combined accumulator and receiver tank, for example, of a transport refrigeration system.

BACKGROUND

Vapor-compression type refrigeration systems are commonly used in transport refrigeration systems, such as temperature controlled trucks or trailers. Some vapor-compression refrigeration systems can switch between a cooling cycle and a heating (and/or defrost) cycle. Such systems may also be called heat pumps.

In some heat pumps, a receiver may be positioned in-line within a refrigerant line between a condenser and an evaporator. In a cooling cycle, the receiver can store liquid refrigerant coming out from the condenser before the refrigerant is driven into the evaporator through a throttle device. In a heating cycle, the receiver may not be necessary and can be by-passed.

In some heat pumps, an accumulator may also be positioned in-line within the refrigerant line between the evaporator and the compressor. In a cooling cycle, the accumulator can trap, for example, liquid refrigerant contained in the refrigerant gas before the refrigerant gas going into the compressor. During a heating and/or defrost cycle, the accumulator may also function as a reservoir to retain liquid refrigerant. Compressor lubrication oil contained in the refrigerant gas may also accumulate in the accumulator before the oil returning to the crankcase of the compressor. Both the receiver and the accumulator generally have an internal reservoir to contain liquids.

SUMMARY

A combined accumulator and receiver tank for a refrigeration system, such as a transport refrigeration system, is described.

In some embodiments, the combined accumulator and receiver tank may include an accumulator portion and a receiver portion. The accumulator portion may be positioned above the receiver portion in a vertical orientation. A pipe may connect the accumulator portion to the receiver portion and a valve may be positioned in-line within the pipe. The valve may have an open and a closed state. In some embodiments, the valve may be in the open state that is configured to allow fluid to flow between the accumulator portion and the receiver portion through the pipe when the refrigeration system is, for example, in a heating and/or defrost cycle. In some embodiments, the valve may be in the closed state configured to prevent fluid from flowing between the accumulator portion and the receiver portion when the refrigeration is, for example, in a cooling cycle.

In some embodiments, the accumulator portion may have an oil level when the refrigeration system is in a heating cycle and the pipe may be connected to the accumulator portion at a place that is above the oil level in the accumulator portion.

Other features and aspects of the embodiments will become apparent by consideration of the following detailed description and accompanying drawings.

BRIEF DESCRIPTION OF THE DRAWINGS

Referring now to the drawings in which like reference numbers represent corresponding parts throughout.

DETAILED DESCRIPTION

A vapor-compression type heat pump (and/or refrigeration system) commonly has a receiver positioned in a liquid line and an accumulator positioned in a suction line to, for example, temporarily store liquid refrigerant.

In the following description of the illustrated embodiments, a combined accumulator and receiver tank is described. The combined accumulator and receiver tank may include an accumulator portion positioned above a receiver portion in a vertical orientation. The accumulator portion may have a pipe connecting the internal space of the accumulator portion and the internal space of the receiver portion. During a heating (and/or defrost) cycle, liquid refrigerant accumulated in the accumulator portion may flow to the receiver portion. Therefore the accumulator portion may not require a reservoir to store the liquid refrigerant, and the size of the accumulator portion may be reduced compared to a conventional accumulator of a refrigeration system. The production costs and space required for installing the combined accumulator and receiver tank may also be reduced compared to a conventional accumulator of a refrigeration system.

References are made to the accompanying drawings that form a part hereof, and in which is shown by way of illustration of the embodiments in which the apparatus may be practiced. The term "in-line" generally means "in fluid communication" or connected. In particular, if a device is positioned in-line within a pipe, it means that a fluid flowing from one end to the other end of the pipe will generally flow through the device. Unless specified, a valve may generally have an "open" state (or position) and a "closed" state (or position). The open state generally permits fluid to flow through the valve and the closed state general prevents fluid flow through the valve. It is to be understood that the terms used herein are for the purpose of describing the figures and embodiments and should not be regarding as limiting the scope of the present application.

Figure 1:
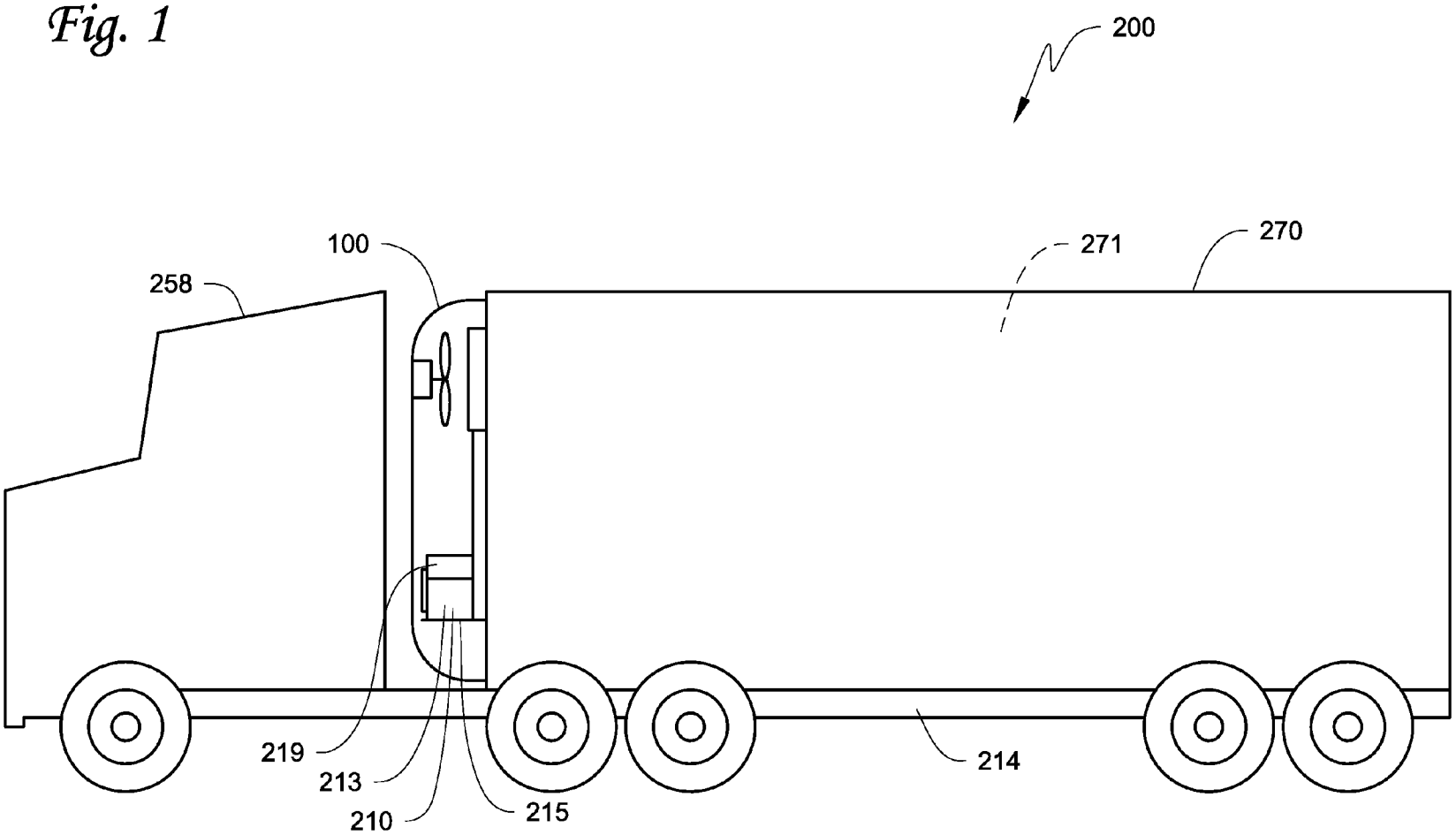
FIG. 1 illustrates a side schematic view of a temperature controlled transport unit with a transport refrigeration system.

Embodiments as described herein may be generally used in a transport refrigeration system (TRS) 200 as illustrated in FIG. 1. FIG. 1 shows a tractor unit 258 that is configured to tow a temperature controlled transport unit 270. The transport unit 270 is installed on a frame 214. A transport refrigeration unit (TRU) 100 is installed on a side wall of the transport unit 270. The TRU 100 is configured to transfer heat between an interior space 271 of the transport unit 270 and the outside environment. A combined accumulator and receiver tank 210 is installed on a platform 215 within the TRU 100. The platform 215 may be generally parallel to the frame 214. The combined accumulator and receiver tank 210 may have an accumulator portion 219 and a receiver portion 213. (See below for detailed description regarding the combined accumulator and receiver tank 10.) The accumulator portion 219 is generally positioned above the receiver portion 213 when installed in the TRU 100.

The TRS 200 is a refrigeration system for controlling refrigeration of the interior space 271 of the transport unit 270. It will be appreciated that the embodiments described herein can be used in any type of transport refrigeration system, including, for example, truck and trailer units, intermodal containers, etc.

Also, the embodiments described herein are not intended only for transport refrigeration systems, but may be used in any other suitable refrigeration system. Further, the refrigeration system may be a vapor-compressor type refrigeration system, or any other suitable refrigeration system that use refrigerant.

Figure 2:
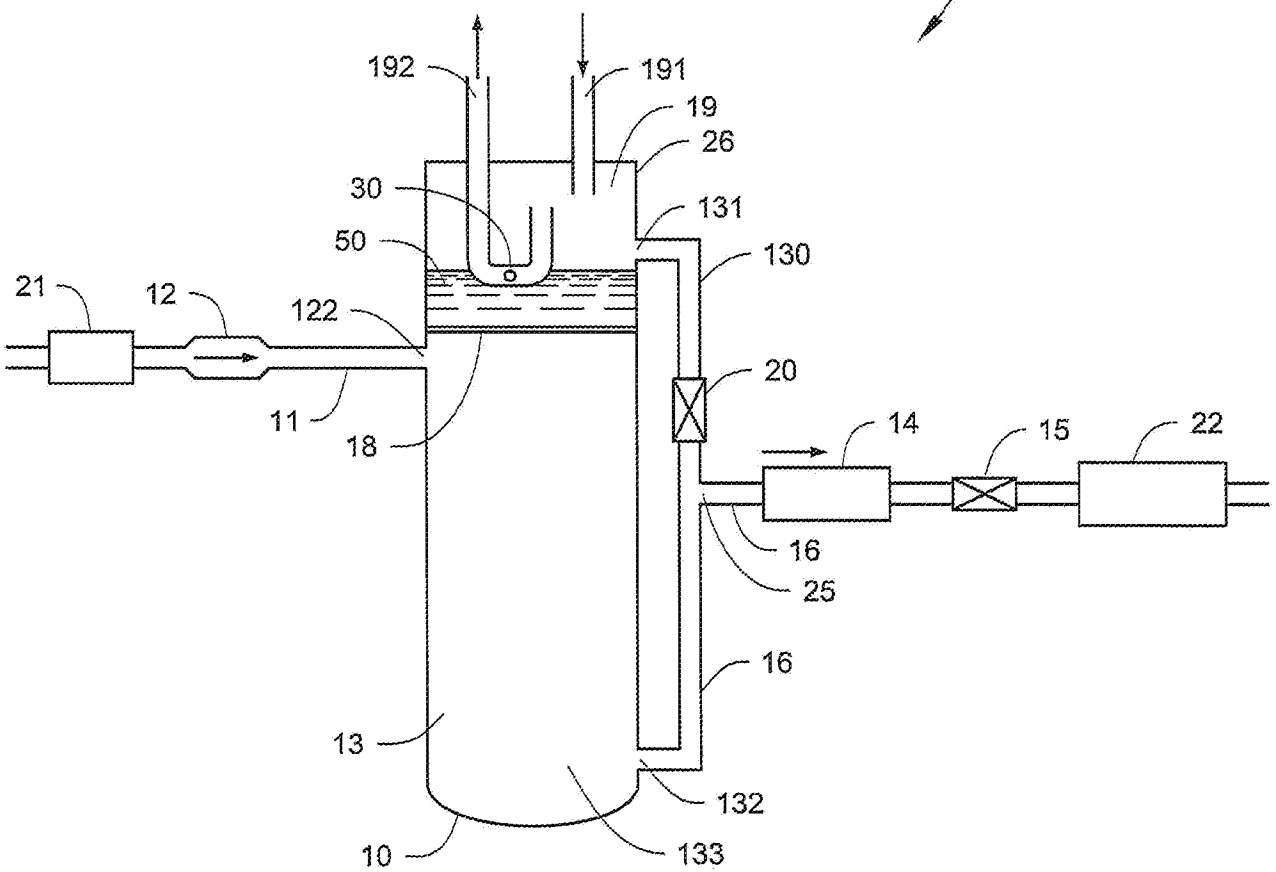
FIG. 2 illustrates a side schematic view of an embodiment of a combined accumulator and receiver tank that is connected to a liquid line between a condenser and an evaporator of a refrigeration system. The combined accumulator and receiver tank is shown in a vertical orientation.

FIG. 2 illustrates the combined accumulator and receiver tank 10 that is connected to a condenser 21 and an evaporator 22 in a refrigeration unit 150. The refrigeration unit 150 can be, for example, a transport refrigeration unit such as the TRU 100 illustrated in FIG. 1. The combined accumulator and receiver tank 10 includes a partition 18 that separates a receiver portion 13 from an accumulator portion 19 that is positioned above the receiver portion 13 in a vertical orientation, as shown in FIG. 2. In some embodiments, the partition 18 can be liquid sealed so that liquid is prevented from flowing between the accumulator portion 19 and the receiver portion 13 through the partition 18. The accumulator portion 19 has an accumulator inlet pipe 191 and an accumulator outlet pipe 192. The accumulator outlet pipe 192 has an oil pick up orifice 30.

The accumulator portion 19 has a side opening 131 that is positioned in a side wall 26 of the accumulator portion 19. When the combined accumulator and receiver tank 10 is in the vertical orientation as shown in FIG. 2, the position of the side opening 131 is generally above the position of the oil pick up orifice 30 relative to the vertical orientation. Referring back to FIG. 1, when the combined accumulator and receiver tank 210 is installed in the transport unit 270, the vertical orientation is generally vertical to the platform 214.

An accumulator/receiver pipe (AR pipe) 130 connects the accumulator side opening 131 to a refrigerant line 16 configured to connect the evaporator 22 and a receiver liquid line outlet 132. The receiver liquid line outlet 132 is in fluid communication with an internal space 133 of the receiver portion 13. In some embodiments, the internal space 133 of the receiver portion 13 may be configured to store liquid refrigerant (not shown). The AR pipe 130 is connected to the refrigerant line 16 and provides fluid communication with the refrigerant line 16 at a junction 25. An AR pipe valve 20 is positioned in-line within the AR pipe 130 between the junction 25 and the side opening 131. In some embodiments, the AR pipe valve 20 can be a normally-closed solenoid valve, which, for example, remains in a closed state when the refrigeration unit 150 is in a cooling cycle, but switches to, for example, an open state when the refrigeration unit 150 is in a heating/defrost cycle.

In some embodiments, the AR pipe valve 20 can be a check valve, with a flow direction from the accumulator portion 19 to the receiver tank 10. During a cooling cycle, the pressure in the receiver tank 10 can be generally higher than the pressure in the accumulation portion 19. Consequently, the AR pipe valve 20 can be closed to prevent the fluid from flowing between the receiver tank 10 and the accumulation portion 19 during the cooling cycle. In a heating/defrost cycle, the check valve can be opened.

A refrigerant filter/drier 14 is positioned in-line within the refrigerant line 16 between the junction 25 and the evaporator 22. In the vertical orientation as shown in FIG. 2, the position of the side opening 131 of the accumulator portion 19 is higher than the position of the junction 25 and the position of the receiver liquid line outlet 132.

In the illustrated embodiment as shown in FIG. 2, the combined accumulator and receiver tank 10 is positioned between the condenser 21 and the evaporator 22. The condenser outlet liquid line 11 has a condenser outlet check valve 12 positioned in-line, and is connected to a receiver portion inlet 122. Further, a liquid line solenoid valve 15 is positioned in-line between the evaporator 22 and the junction 25.

In operation, during a cooling cycle, liquid refrigerant can flow into the receiver portion inlet 122 of the receiver portion 13 from the condenser outlet liquid line 11. The liquid line solenoid valve 15 is in an open state and a refrigerant in the receiver portion 13 flows out of the receiver liquid line outlet 132 and into the evaporator 22 of the refrigeration unit 150 through the refrigerant line 16. The refrigerant then flows into the accumulator inlet pipe 191 and flows out of the accumulator outlet pipe 192 of the accumulator portion 19 as shown by arrows in FIG. 2. The AR pipe valve 20 is in a closed state to prevent refrigerant flow between the accumulator portion 19 and the receiver portion 13.

In some embodiments, due to feedback control of the amount of liquid refrigerant going into the evaporator 22 by a throttle device (not shown) during the cooling cycle, the refrigerant flowing into the accumulator portion 19 may generally be in a vapor state and contain very little liquid refrigerant when exiting the evaporator 22. In some embodiments, the accumulator portion 19 may be equipped with an accumulator heater (not shown) to vaporize liquid refrigerant that may accumulate inside the accumulator portion 19, during, for example, a heating cycle.

In a heating and/or defrost cycle, the direction of the refrigerant flow is generally reversed compared to the direction of the refrigerant flow in a cooling cycle as shown by arrows in FIG. 2. Liquid refrigerant flows into the accumulator portion 19 during a heating and/or defrost cycle. The valve 20 is in an open state that is configured to allow fluid to flow between the accumulator portion 19 and the receiver portion 13. The accumulator portion 19 is configured so that the accumulator portion 19 generally does not store refrigerant inside the accumulator portion 19. As a result, in the heating cycle, the liquid refrigerant accumulated in the accumulator portion 19 can quickly overflow from the accumulator side opening 131 and flow to the receiver portion 13 that is positioned below the accumulator portion 19 for storage. The liquid refrigerant is stored in the internal space 133 of the receiver portion 13 that can be configured to store the liquid refrigerant.

As mentioned earlier, the position of the side opening 131 is generally above the oil pick up orifice 30 in a vertical orientation as shown in FIG. 2 to prevent oil 50 that may accumulate in the accumulator portion 19 from getting into the receiver portion 13. In some embodiments, the side opening 131 may be generally positioned higher than the maximum possible oil level in the accumulator portion 19 when the refrigeration unit 150 is in a heating and/or defrost cycle.

The configurations and designs of the AR pipe 130 may vary. It should be noted that the AR pipe 130 does not have to be connected to the refrigerant line 16. The AR pipe 130 can be connected to the receiver portion 13 in an opening that is separate from the liquid line outlet 132. (See FIG. 3 and the description below for one example.) The AR pipe 130 may generally be configured to allow fluid flow between the accumulator portion 19 and the receiver portion 13 during a heating (and/or defrost) cycle of the refrigeration system.

In some embodiments, the junction 25 may be equipped with a three way valve (not shown) that has at least a first state and a second state. At the first state, the three-way valve can be configured to block fluid communication between the AR pipe 130 and the refrigerant line 16 when the refrigeration unit 150 is in, for example, a cooling cycle. In the second state, the valve can be configured to allow fluid communication between the AR pipe 130 and the refrigerant line 16 when the refrigeration system is in, for example, a heating and/or defrost cycle. In this configuration, the AR pipe valve 20 may not be necessary.

As shown in FIG. 2, in some embodiments, the AR pipe 130 is connected to the receiver inlet 122. Particularly, the AR pipe 130 is connected to and provides fluid communication with the condenser outlet liquid line 11 between the condenser outlet check valve 12 and the receiver inlet 122. When the refrigeration system is in, for example, a cooling cycle, the AR pipe valve 20 is in the closed state to prevent refrigerant from flowing from the condenser outlet liquid line 11 to the accumulator portion 19 directly. When the refrigeration system is, for example, in a heating cycle, the AR pipe 20 is in an open state to allow refrigerant to flow from the condenser outlet liquid line 11 to the accumulator portion 19 directly.

It would be appreciated that the accumulator portion 13 of the combined accumulator and receiver tank 10 as shown in FIG. 2 may have a reduced size compared to a conventional accumulator of a comparable capacity and functionality. Since the combined accumulator and receiver tank 10 can allow refrigerant to flow from the accumulator portion 19 to the receiver portion 13 continuously in the heating cycle, the accumulator portion 19 does not need to have a reservoir to store liquid refrigerant. Thus the size of the accumulator portion 19 can be reduced compared to a conventional design. In some embodiments, the size of the accumulator portion 19 may be reduced to about ⅕ of the size of an accumulator of a comparable capacity and functionality. This may help save space and production costs.

It should also be appreciated that the receiver portion 19 and the accumulator portion 13 do not have to be configured as a single combined tank, such as shown in FIG. 2. A receiver portion and an accumulator portion may be configured as two separated tanks (not shown), and the accumulator portion may be positioned above the receiver portion in a vertical orientation and connected to the receiver portion by an AR pipe, when the accumulator portion and the receiver portion are installed in a transport unit, (e.g. the transport unit 270 shown in FIG. 1).

It should also be noted that the combined accumulator and receiver tank 10 may also be used with a refrigeration system that does not have a liquid line solenoid. One example of such a system may be found in single temperature truck produced by the Thermo King Corporation, or trailer units, such as Thermo King T series truck units.

It should also be appreciated that the accumulator portion 13 of the combined accumulator and receiver tank 10 as shown in FIG. 2 can help improve the heating and/or defrost capacity. This is because refrigerant getting into the accumulator portion 19 during the heating and/or defrost cycles can return to the receiver portion 13 to be used again immediately during the heating and/or defrost cycles. The combined accumulator and receiver tank 10 as described herein can also prevent flooding that may occur within an accumulator through the oil pickup orifice 30, because the amount of refrigerant in the accumulator portion 19 is reduced. During a system operation mode switching between, for example, cooling and heating/defrost cycles, particularly from a heating/defrost cycle to a cooling cycle, the combined accumulator and receiver tank 10 as described herein may also help prevent liquid refrigerant from entering into the compressor because of the reduced amount of liquid refrigerant accumulated in the accumulator portion 19.

In some embodiments, due to, for example, a relatively high discharge pressure, the refrigerant accumulated in the accumulation portion 19 can flow to the receiver tank 10 during a cooling mode. This may help maximize the refrigerant available in the receiver tank 10 when the system operation mode switches from a cooling mode to a heating/defrost mode.

Figure 3:
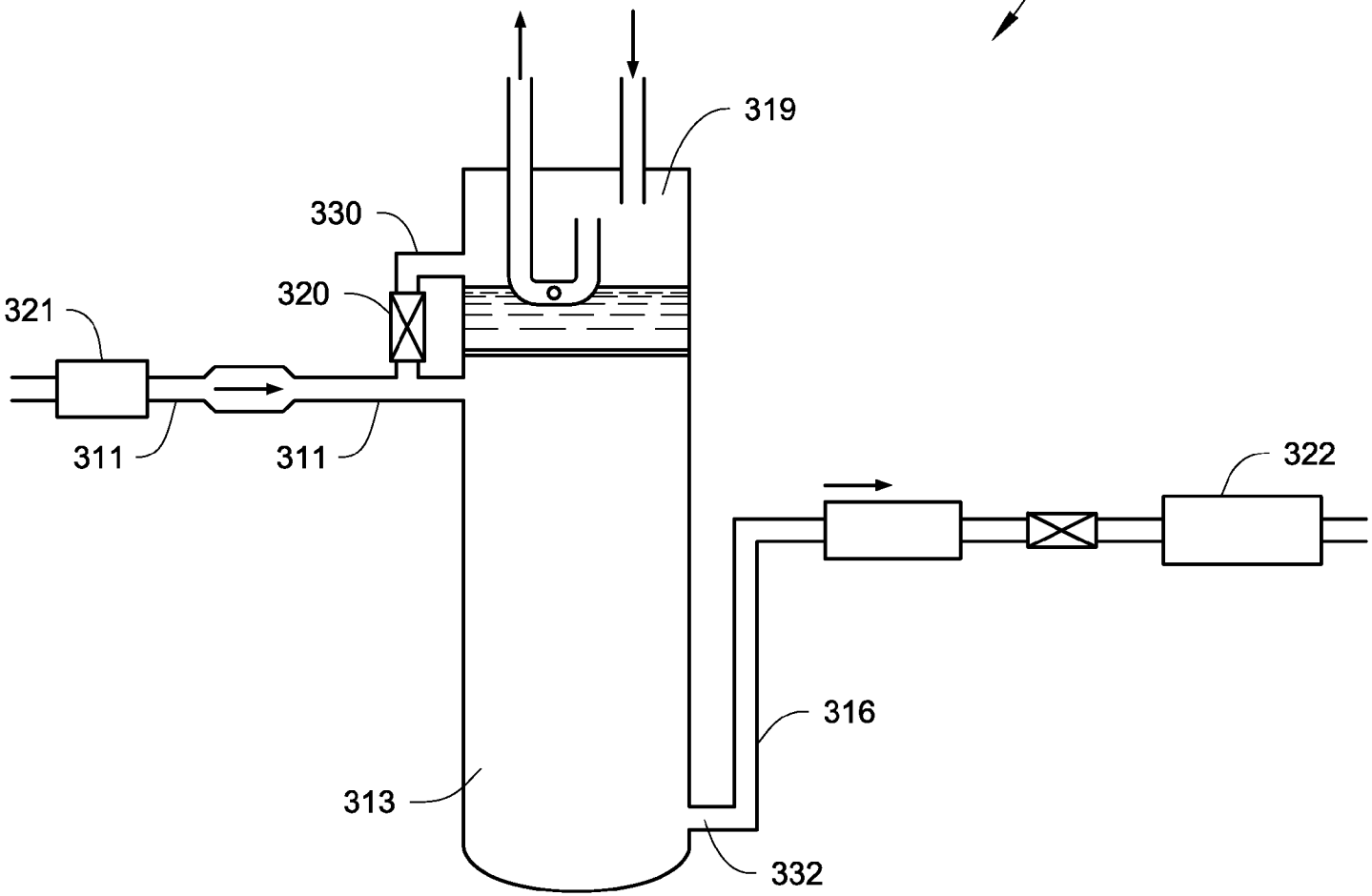
FIG. 3 illustrates a side schematic view of another embodiment of a combined accumulator and receiver tank that is connected to a liquid line between a condenser and an evaporator of a refrigeration system. The combined accumulator and receiver tank is shown in a vertical orientation.

FIG. 3 illustrates another embodiment of a combined accumulator and receiver tank 300. The combined accumulator and receiver tank 300 is coupled to a condenser 321 and an evaporator 322. In this embodiment, an accumulator portion 319 has an AR pipe 330 connected to a condenser outlet liquid line 311. The AR pipe 330 is equipped with a normally closed solenoid valve 320. A refrigerant line 316 connected to a receiver liquid line outlet 332 of a receiver portion 313 is not directly connected to the accumulator portion 319 in the illustrated embodiment of FIG. 3.

Aspects

It is noted that any of aspects 1-7 below can be combined with any of aspects 8-17. Any of aspects 8-15 can be combined with any of aspects 16-17.

Aspect 1. A combined accumulator and receiver tank of a refrigeration system comprising:

an accumulator portion;

a receiver portion positioned below the accumulator portion in a vertical orientation;

a pipe having a first end that is in fluid communication with the accumulator portion and a second end that is in fluid communication with the receiver portion; and a valve positioned between the first end and the second end of the pipe, wherein the valve has an open state and a closed state, when the valve is in the open state, the valve is configured to allow fluid to flow between the accumulator portion and the receiver portion through the pipe, and when the valve is in the closed state, the valve is configured to prevent fluid from flowing between the accumulator portion and the receiver portion.

Aspect 2. The combined accumulator and receiver tank of aspect 1, wherein the valve is configured to be in the close state when a refrigeration system including the combined accumulator and receiver tank is operated in a cooling cycle.

Aspect 3. The combined accumulator and receiver tank of aspects 1-2, wherein the valve is configured to be in the open state when a refrigeration system including the combined accumulator and receiver tank is operated in a heating cycle.

Aspect 4. The combined accumulator and receiver tank of aspects 1-3, wherein the pipe is configured to provide fluid communication with a liquid line connected to an evaporator in a refrigeration system.

Aspect 5. The combined accumulator and receiver tank of aspects 1-4, wherein the accumulator portion includes an oil pick up orifice, and the second end of the pipe provides fluid communication with the accumulator portion at a location that is above the oil pick orifice in the vertical orientation.

Aspect 6. The combined accumulator and receiver tank of aspects 1-5, wherein a refrigeration system including the combined accumulator and receiver tank has a maximum oil level in the accumulator portion during operation, and the first end of the pipe provides fluid communication with the accumulator portion at a location that is above the maximum oil level in the vertical orientation.

Aspect 7. The combined accumulator and receiver tank of aspects 1-6, wherein the pipe is configured to provide fluid communication with a liquid line connected to a condenser in a refrigeration system.

Aspect 8. A refrigeration system comprising:

a condenser;

an evaporator;

a combined accumulator and receiver tank having an accumulator portion and a receiver portion, the accumulator portion being positioned above the receiver portion in a vertical orientation, the receiver portion having an inlet and an outlet, wherein the inlet is in fluid communication with the condenser and the outlet is in fluid communication with the evaporator;

a pipe having a first end that is in fluid communication with the accumulator portion, and a second end that is in fluid communication with the receiver portion; and a valve positioned in the pipe between the first end and the second end, wherein the valve is configured to have an open state and a closed state, when the valve is in the open state, the valve is configured to allow fluid to flow between the accumulator portion and the receiver portion through the pipe, and when the valve is in the closed state, the valve is configured to prevent fluid from flowing between the accumulator portion and the receiver portion.

Aspect 9. The refrigeration system of aspect 8, wherein the valve is configured to be in the closed state when the refrigeration system is in a cooling cycle.

Aspect 10. The refrigeration system of aspects 8-9, wherein the valve is configured to be in the open state when the refrigeration system is in a heating cycle.

Aspect 11. The refrigeration system of aspects 8-10, wherein the pipe is in fluid communication with a liquid line that is connected to the evaporator.

Aspect 12. The refrigeration system of aspects 8-11, wherein the pipe is in fluid communication with a liquid line that is connected to the condenser.

Aspect 13. The refrigeration system of aspects 8-12, wherein the accumulator portion has a maximum oil level when the refrigeration system is in a heating cycle, the first end of the pipe being connected to the accumulator portion that is above the maximum oil level in the accumulator portion in the vertical orientation.

Aspect 14. The combined accumulator and receiver tank of aspects 8-13, wherein the accumulator portion includes an oil pick up orifice, and the second end of the pipe provides fluid communication with the accumulator portion at a location that is above the oil pick orifice in the vertical orientation.

Aspect 15. The refrigeration system of aspects 8-14 is a transport refrigeration unit.

Aspect 16. A method of directing refrigerant in a refrigeration system comprising:

during a heating cycle of the refrigeration system, directing the refrigerant to an accumulator that is positioned above an receiver in a vertical orientation;

during the heating cycle, allowing the refrigerant to flow from the accumulator to the receiver; and during a cooling cycle, preventing the refrigerant from flowing between the accumulator and the receiver.

Aspect 17. The method of aspect 16, wherein the refrigeration system is a transport refrigeration system.

With regard to the foregoing description, it is to be understood that changes may be made in detail, especially in matters of the construction materials employed and the shape, size and arrangement of the parts without departing from the scope of the present invention. It is intended that the specification and depicted embodiment to be considered exemplary only, with a true scope and spirit of the invention being indicated by the broad meaning of the claims.

What claimed is:

1. A combined accumulator and receiver tank of a refrigeration system comprising:

an accumulator portion;

a receiver portion positioned below the accumulator portion in a vertical orientation;

a pipe having a first end that is connected to the accumulator portion and a second end that is connected to the receiver portion, and wherein the pipe includes a junction between the first end and the second end, and wherein the junction connects the pipe to a heat exchanger via a refrigerant line; and a valve positioned between the first end and the second end of the pipe, wherein the valve has an open state and a closed state, when the valve is in the open state, the valve is configured to allow fluid to flow between the accumulator portion and the receiver portion through the pipe, and when the valve is in the closed state, the valve is configured to prevent fluid from flowing between the accumulator portion and the receiver portion, wherein the valve is configured to remain in the closed state when a refrigeration system including the combined accumulator and receiver tank is operated in a cooling cycle, wherein the junction is positioned between the valve and the second end of the pipe to prevent fluid flow between the accumulator and the heat exchanger when the valve is in a closed state.

2. The combined accumulator and receiver tank of claim 1, wherein the pipe is configured to provide fluid communication with the refrigerant line connected to an evaporator in the refrigeration system.

3. The combined accumulator and receiver tank of claim 1, wherein the accumulator portion includes an oil pick up orifice, and the second end of the pipe provides fluid communication with the accumulator portion at a location that is above the oil pick orifice in the vertical orientation.

4. The combined accumulator and receiver tank of claim 1, wherein the refrigeration system including the combined accumulator and receiver tank has a maximum oil level in the accumulator portion during operation, and the first end of the pipe provides fluid communication with the accumulator portion at a location that is above the maximum oil level in the vertical orientation.

5. The combined accumulator and receiver tank of claim 1, wherein the pipe is configured to provide fluid communication with the refrigerant line connected to a condenser in the refrigeration system.

6. The combined accumulator and receiver tank of claim 1, further comprising a second valve positioned along the refrigerant line between the junction and the heat exchanger, the second valve configured to be in an open state during the cooling cycle to direct refrigerant from the receiver portion to the heat exchanger.

7. The combined accumulator and receiver tank of claim 6, further comprising a drier positioned along the refrigerant line between the junction and the second valve.

8. The combined accumulator and receiver tank of claim 1, wherein the junction includes a three way valve having a first state that is configured to block fluid communication between the pipe and the refrigerant line when the refrigeration system is in the cooling cycle and a second state that is configured to allow fluid communication between the pipe and the refrigerant line when the refrigeration system is in a heating or defrost cycle.

9. A refrigeration system comprising:

a condenser;

an evaporator;

a combined accumulator and receiver tank having an accumulator portion and a receiver portion, the accumulator portion being positioned above the receiver portion in a vertical orientation, the receiver portion having an inlet and an outlet, wherein the inlet is in fluid communication with the condenser and the outlet is in fluid communication with the evaporator;

a pipe having a first end that is connected to the accumulator portion, and a second end that is connected to the receiver portion, and wherein the pipe includes a junction between the first end and the second end, and wherein the junction connects the pipe to the evaporator via a refrigerant line; and a valve positioned in the pipe between the first end and the second end, wherein the valve is configured to have an open state and a closed state, when the valve is in the open state, the valve is configured to allow fluid to flow between the accumulator portion and the receiver portion through the pipe, and when the valve is in the closed state, the valve is configured to prevent fluid from flowing between the accumulator portion and the receiver portion, wherein the valve is configured to remain in the closed state when the refrigeration system is in a cooling cycle, and wherein the junction is positioned between the valve and the second end of the pipe to prevent fluid flow between the accumulator and the heat exchanger when the valve is in a closed state.

10. The refrigeration system of claim 9, wherein the accumulator portion has a maximum oil level when the refrigeration system is in a heating cycle, the first end of the pipe being connected to the accumulator portion that is above the maximum oil level in the accumulator portion in the vertical orientation.

11. The combined accumulator and receiver tank of claim 9, wherein the accumulator portion includes an oil pick up orifice, and the second end of the pipe provides fluid communication with the accumulator portion at a location that is above the oil pick orifice in the vertical orientation.

12. The refrigeration system of claim 9 is a transport refrigeration unit.

13. A method of directing refrigerant in a refrigeration system comprising:

during a heating cycle of the refrigeration system, directing the refrigerant to an accumulator of a combined accumulator and receiver tank that includes the accumulator and a receiver wherein the accumulator is positioned above the receiver in a vertical orientation;

during the heating cycle, allowing the refrigerant to flow from the accumulator to the receiver via a pipe of the combined accumulator and receiver tank, the pipe having a first end that is connected to the accumulator and a second end that is connected to the receiver, wherein the pipe includes a junction between the first end and the second end, wherein the junction connects the pipe to a heat exchanger via a refrigerant line, wherein the junction is positioned between the valve and the second end of the pipe to prevent fluid flow between the accumulator and the heat exchanger when the valve is in a closed state, and wherein the junction is positioned between the valve and the second end of the pipe to prevent fluid flow between the accumulator and the heat exchanger when the valve is in a closed state; and during an entire cooling cycle, preventing the refrigerant from flowing between the accumulator and the receiver via a valve positioned in the pipe between the first end and the second end that remains in a closed state.

14. The method of claim 13, wherein the refrigeration system is a transport refrigeration system.

15. A combined accumulator and receiver tank of a refrigeration system comprising:

an accumulator portion;

a receiver portion positioned below the accumulator portion in a vertical orientation;

a pipe having a first end that is connected to the accumulator portion and a second end that is connected to the receiver portion, wherein the pipe includes a junction between the first end and the second end, and wherein the junction connects the pipe to a heat exchanger via a refrigerant line; and a valve positioned between the first end and the second end of the pipe, wherein the valve has an open state and a closed state, when the valve is in the open state, the valve is configured to allow fluid to flow between the accumulator portion and the receiver portion through the pipe, and when the valve is in the closed state, the valve is configured to prevent fluid from flowing between the accumulator portion and the receiver portion, wherein the valve is configured to be in the open state when a refrigeration system including the combined accumulator and receiver tank is operated in a heating cycle, wherein the junction is positioned between the valve and the second end of the pipe to prevent fluid flow between the accumulator and the heat exchanger when the valve is in a closed state.

16. A refrigeration system comprising:

a condenser;

an evaporator;

a combined accumulator and receiver tank having an accumulator portion and a receiver portion, the accumulator portion being positioned above the receiver portion in a vertical orientation, the receiver portion having an inlet and an outlet, wherein the inlet is in fluid communication with the condenser and the outlet is in fluid communication with the evaporator;

a pipe having a first end that is connected to the accumulator portion, and a second end that is connected to the receiver portion, wherein the pipe includes a junction between the first end and the second end, and wherein the junction connects the pipe to the evaporator via a refrigerant line; and a valve positioned in the pipe between the first end and the second end, wherein the valve is configured to have an open state and a closed state, when the valve is in the open state, the valve is configured to allow fluid to flow between the accumulator portion and the receiver portion through the pipe, and when the valve is in the closed state, the valve is configured to prevent fluid from flowing between the accumulator portion and the receiver portion, and wherein the valve is configured to be in the open state when the refrigeration system is in a heating cycle, wherein the junction is positioned between the valve and the second end of the pipe to prevent fluid flow between the accumulator and the heat exchanger when the valve is in a closed state.

* * * * *